US006764353B2

(12) United States Patent
Freitag

(10) Patent No.: US 6,764,353 B2
(45) Date of Patent: Jul. 20, 2004

(54) BATTERY TERMINAL CONNECTOR

(75) Inventor: Erik Freitag, Arlington Heights, IL (US)

(73) Assignee: Royal Die & Stamping Co., Inc., Bensenville, IL (US)

( * ) Notice: Subject to any disclaimer, the term of this patent is extended or adjusted under 35 U.S.C. 154(b) by 0 days.

(21) Appl. No.: 10/177,289

(22) Filed: Jun. 21, 2002

(65) Prior Publication Data

US 2003/0236033 A1 Dec. 25, 2003

(51) Int. Cl.[7] ..... H01R 4/42
(52) U.S. Cl. ..... 439/763; 439/907
(58) Field of Search ..... 439/522, 762, 439/763, 764, 765, 766, 907

(56) References Cited

U.S. PATENT DOCUMENTS

| | | | | |
|---|---|---|---|---|
| 3,568,138 A | | 3/1971 | Bakker | |
| 4,054,355 A | | 10/1977 | Kourimsky | |
| 4,063,794 A | * | 12/1977 | Dittmann | 439/763 |
| 4,126,367 A | * | 11/1978 | Miller | 439/504 |
| 4,354,726 A | | 10/1982 | Kato et al. | |
| 5,316,505 A | | 5/1994 | Kipp | |
| 5,346,407 A | * | 9/1994 | Hood | 439/522 |
| 5,599,210 A | | 2/1997 | Green | |
| 5,672,442 A | | 9/1997 | Burnett | |
| 5,711,688 A | | 1/1998 | Matsunaga et al. | |
| 5,733,152 A | * | 3/1998 | Freitag | 439/763 |
| 5,738,552 A | | 4/1998 | Halbach et al. | |
| 5,800,219 A | | 9/1998 | Siedlik et al. | |
| 5,879,202 A | | 3/1999 | Zhao | |
| 5,941,738 A | | 8/1999 | Matsunaga et al. | |
| 6,250,973 B1 | * | 6/2001 | Lowery et al. | 439/763 |

* cited by examiner

*Primary Examiner*—Lynn Feild
*Assistant Examiner*—Thanh-Tam Le
(74) *Attorney, Agent, or Firm*—Wallenstein Wagner & Rockey, Ltd.

(57) ABSTRACT

A battery terminal connector having a body portion. The body portion has a front end and a back end, and a first and a second ferrule. The second ferrule is secured to the front end of the body portion, and the first ferrule is connected to the back end of the body portion. The first ferrule is separated from the second ferrule by an angle of between approximately 150–180 degrees. A line passing through the axis of the first ferrule and second ferrule passes through the battery terminal post to which the terminal connector is attached.

17 Claims, 2 Drawing Sheets

BATTERY TERMINAL CONNECTOR

DESCRIPTION

1. Technical Field

This invention is directed to a battery terminal connector, and more particularly to a battery connector that is an improvement over that described in U.S. Pat. No. 5,733,152.

2. Background of the Invention

Storage batteries of the type used in automobiles, trucks and the like, generally have a terminal post made of a lead alloy material with a cylindrical or frustoconical shape. The battery is connected to the vehicle electrical system by a battery cable assembly. The cable assembly has connectors which clamp to the battery posts, providing an electrical and mechanical connection.

A conventional connector for connecting cables to the battery is a molded, generally U-shaped device with a bolt passing through outwardly projecting yoke-like arms for securely clamping the connector to the battery post. The connector may also be a stamped metal battery terminal connector, fabricated from sheet metal.

U.S. Pat. No. 5,733,152 ("the '152 patent") is directed to a battery terminal connector. The '152 patent is owned by the assignee of the present application, and relates to a battery terminal connector which permits improved mechanical and electrical connection to a battery terminal post. The connector of the '152 patent has enhanced resistance to rotation when connected to a battery terminal post. That connector is also economical to manufacture, and is adaptable for automated assembly and production. An additional advantage of this connector is that it is adaptable to different automobile models and batteries. This results from the variability of the configurations and styles of the ferrule or "grip" portion. The variable configurations of the ferrule portion prevent battery cables from extending above the top of the battery. This design also permits the battery cable to fit into tighter spaces, and thus more efficiently around the battery.

Additional relevant prior art references include U.S. Pat. Nos. 6,250,973, 5,941,738, 5,879,202, 5,800,219, 5,738,552, 5,711,688, 5,672,442, 5,599,210, 5,316,505, 4,354,726, 4,063,794, 4,054,355, and 3,568,138. None of these patents, however, alone or in combination, disclose the present invention.

SUMMARY OF THE INVENTION

This invention is a battery terminal connector. The connector has a body portion, and that body portion has a front end and a back end. The connector further includes a first and a second ferrule or "grip". The second ferrule is secured to the front end of the body portion, and the first ferrule is connected to the back end of the body portion.

The ferrules may be separated from each other by angles of between 150 and 180 degrees. In a most preferred embodiment, the separation is approximately 180 degrees. In this most preferred embodiment, a line passing through the axis of the first ferrule and the second ferrule passes through the battery terminal post to which the terminal connector is attached.

The battery terminal connector of the invention is preferably stamped. It is most preferably made of copper. It is also most preferably made of one piece.

The battery terminal connector of the invention also includes an auxiliary threaded rod-type terminal. Electrical cables may be attached between, for example, a power winch or other power consuming devices and this auxiliary, threaded rod-type terminal. In this way, these power consuming devices may be powered by the same battery to which the battery terminal connector of the invention is secured.

Finally, the connector includes a tightening nut that may be accessed on either the right or left side of the connector.

DETAILED DESCRIPTION

There are many possible embodiments of this invention. The drawings and description below describe in detail a preferred embodiment of the invention. It should be understood that the present disclosure is to be considered as an example of the principles of the invention. The disclosure is not intended to limit the broad aspect of the invention to the embodiments illustrated.

This invention is an improvement over the battery terminal connector disclosed in U.S. Pat. No. 5,733,152. The disclosures, including the specification and Figures, of that patent, are incorporated herein by reference.

Figure 1:
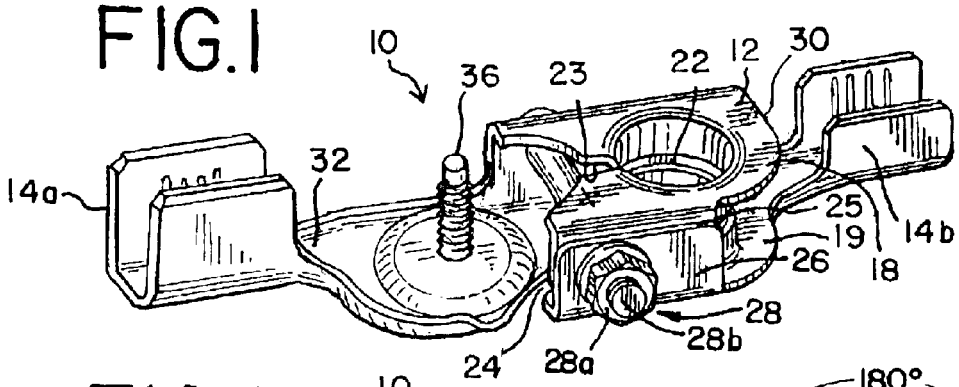
FIG. 1 is a perspective view of a first embodiment of the battery terminal connector of the present invention.

Referring to the drawings, FIG. 1 shows a perspective view of one embodiment of the battery terminal connector 10 in accordance with the invention. The connector 10 comprises essentially two main portions stamped from a single piece of metal, a middle contacting or body portion 12 and a ferrule portion 14. The contacting or body portion 12 includes a part that is to be fitted over a typically frustoconical shaped terminal post (not shown) of a battery for a motor vehicle. The contacting or body portion 12 also includes an auxiliary terminal, to be described below.

The ferrule portion 14 is adapted for connecting and securing a battery cable (not shown) through the contacting or body portion 12 to the battery. The ferrule portion 14 is made up of two elements at opposite ends of connector 10. In this embodiment, the ferrule portion includes a first ferrule or first grip 14*a* and a second ferrule or second grip 14*b*.

Figure 5:
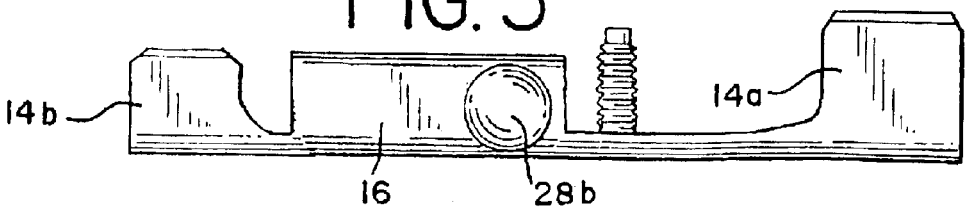
FIG. 5 is a left side view of the connector of FIG. 1.

As shown in FIG. 1, the contacting or body portion 12 is formed by a first semicircular side 18 opposed from and interconnected by a flat connecting section 16 (FIG. 5) to a second semicircular side 19. Opposed from the connecting section 16, each side includes a set of end tabs 25, 26, to be described in further detail below.

Figure 2:
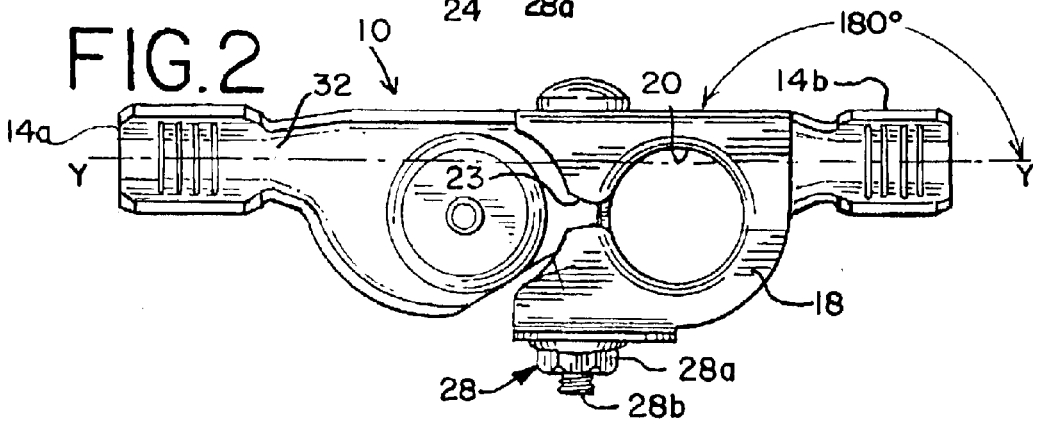
FIG. 2 is a top view of the connector of FIG. 1.
Figure 3:
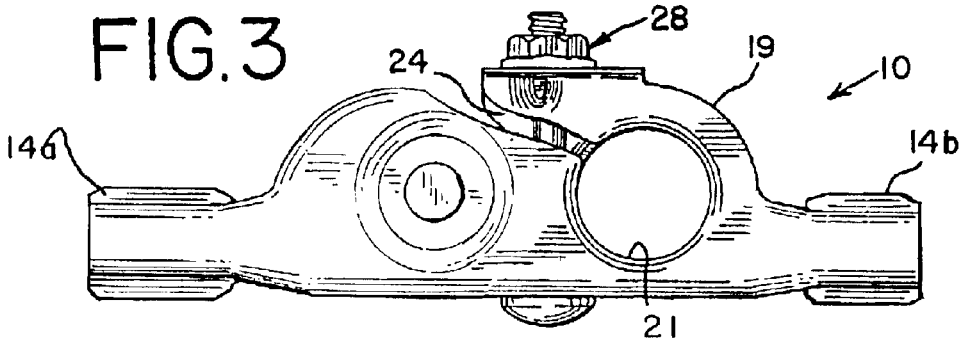
FIG. 3 is a bottom view of the connector of FIG. 1.

The sides 18, 19 include slotted openings 23, 24. FIG. 2 shows one of the slotted openings 23, while FIG. 3 shows the opposite slotted opening 24. The slotted openings 23, 24 are situated across from one another in a slightly off-set alignment. Off-set alignment of the slotted openings 23, 24 offers several advantages, including improved contact with the battery terminal post, providing better current.

Each side 18, 19 has a centrally positioned aperture 20, 21, respectively. Each aperture is adapted for receiving the terminal post of a battery. The apertures 20, 21 are designed to position the connector 10, and specifically the contacting portion 12, securely around the frustoconical shaped battery terminal post. Specifically, the inner diameter of the first aperture 20 is slightly smaller than the inner diameter of the second aperture 21, to accommodate the frustoconical shape of the terminal post. This enhances the electrical and mechanical connections of the connector 10 to the terminal post. Further, the apertures 20, 21 are dimensioned for a snug fit on the terminal post when the connector 10 is placed on the terminal post in the open position, prior to clamping.

The distal ends of the first and second sides 18, 19 include generally rectangular, end tab portions 25, 26. These end tabs 25, 26 are adapted for overlapping engagement and attachment to one another (FIG. 1). Each of the end tabs 25, 26 includes a central opening for receiving a fastener 28. Any conventional fastener 28 can be used, with a threaded fastener such as a nut 28*a* and bolt assembly 28*b*, shown in FIGS. 2 and 3, being preferred for a secure connection. When the end tabs 25, 26 are aligned in an overlapping relationship, the fastener 28 can be threaded through the openings in those end tabs 25, 26.

Figure 4:
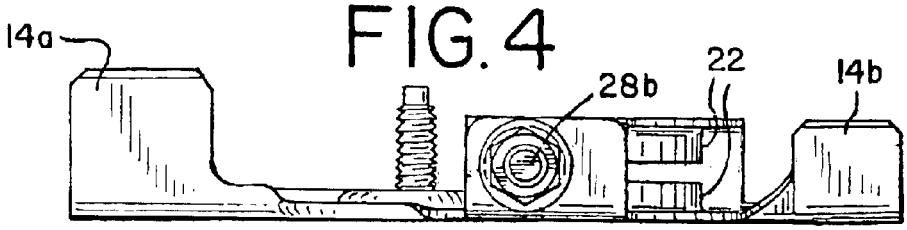
FIG. 4 is a right side view of the connector of FIG. 1.

When the connector 10 is properly seated about the terminal post, the bolt 28*b*, if not in place, is fed through the aligned central openings. The nut 28*a* is then tightened through clockwise rotation, drawing the end tabs 25, 26, the sides 18, 19, and a pair flanges 22 (FIG. 4) together into closer contact with the battery terminal post. As the sides 18, 19 are drawn together, flanges 22 will clamp securely around the terminal post, producing good electrical and mechanical contact with the terminal post. Conversely, rotating the nut 28*a* in the opposite direction causes the end tabs to draw apart, opening up the sides 18, 19 for easy removal of the connector 10 from the terminal post. Thus, the nut and bolt fastener assembly 28 provides a convenient means for attachment and disconnection of the connector 10 from the terminal post.

The connector 10 is formed from a metal blank, such as a single piece of copper or sheet metal. Manufacturing the connector 10 by a stamping process as a single blank is convenient and cost-efficient.

Figure 8:
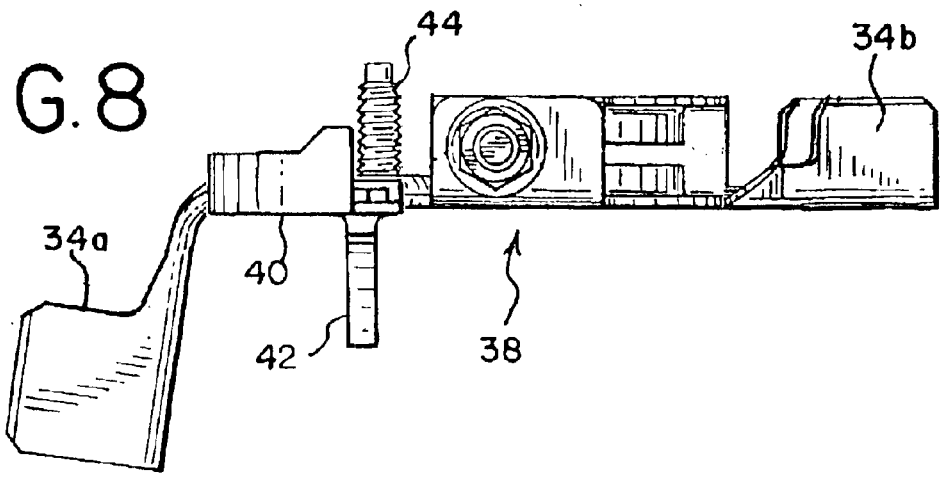
FIG. 8 is a side view of the connector of FIG. 6.

As noted above, the connector 10 has a body portion 12, and that body portion 12 has a front end 30 and a back end 32. The connector 10 further includes a first ferrule or "grip" 14*a* and a second ferrule or "grip" 14*b*. In the embodiment of FIG. 1, the ferrules or grips 14*a* and 14*b* are coaxial. In contrast, in the alternate embodiment of FIG. 6, the axes of the first ferrule 34*a* and the second ferrule 34*b* are generally perpendicular. This generally perpendicular arrangement is best shown in FIG. 8.

Referring again to FIG. 1, the second ferrule 14*b* is secured to the front end 30 of the body portion 12. This novel feature in a battery terminal connector 10 provides significant advantages over the prior art connectors. Particularly, the terminal connector construction shown permits two batteries to be more easily connected together in an in-line configuration. Such an in-line or "series" configuration is necessary for large or heavy-duty vehicles, where one conventional vehicle battery is inadequate. Both terminal connectors shown in this specification, i.e., the terminal connectors of FIGS. 1–5 and of FIGS. 6–8, permit two adjacent batteries to be easily connected. These connectors eliminate the need to bring a cable from a position near the back end 32 of the body portion 12 of connector 10, and also eliminate the need to awkwardly wrap a cable around the case of the battery.

In this preferred embodiment of FIGS. 1–5, the first ferrule 14*a* is connected to the back end 32 of the body portion 12.

The ferrules 14 and 32 are preferably separated from each other by angles in the range of 150 to 180 degrees. In a most preferred embodiment, as shown in FIGS. 1 and 2, the separation is approximately 180 degrees. In this most preferred embodiment, a line y—y passing through the axis of the first ferrule 14*a* and the axis of the second ferrule 14*b* passes through the battery terminal post (not shown) to which the terminal connector 10 is attached.

Figure 6:
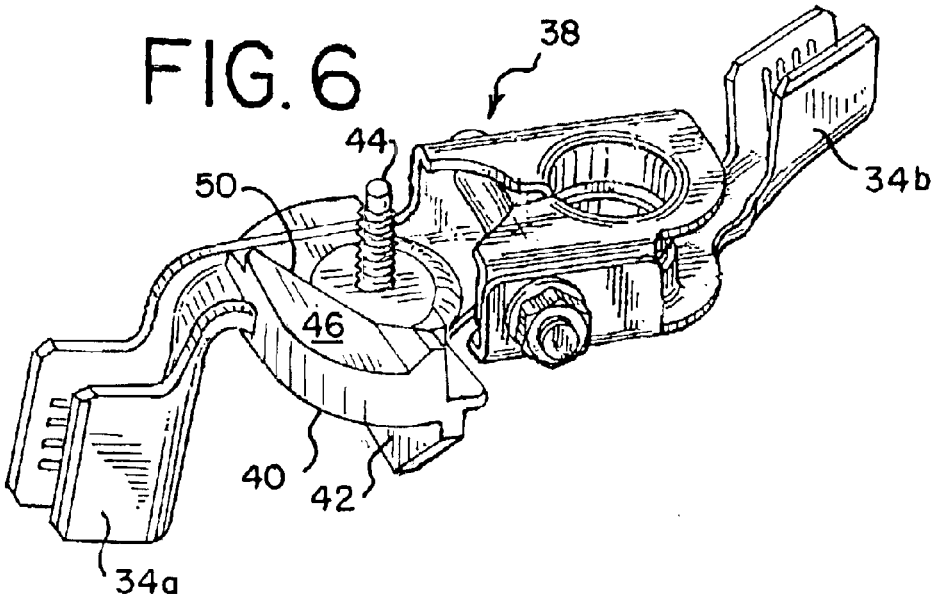
FIG. 6 is a perspective view of a second embodiment of the battery terminal connector of the present invention.
Figure 7:
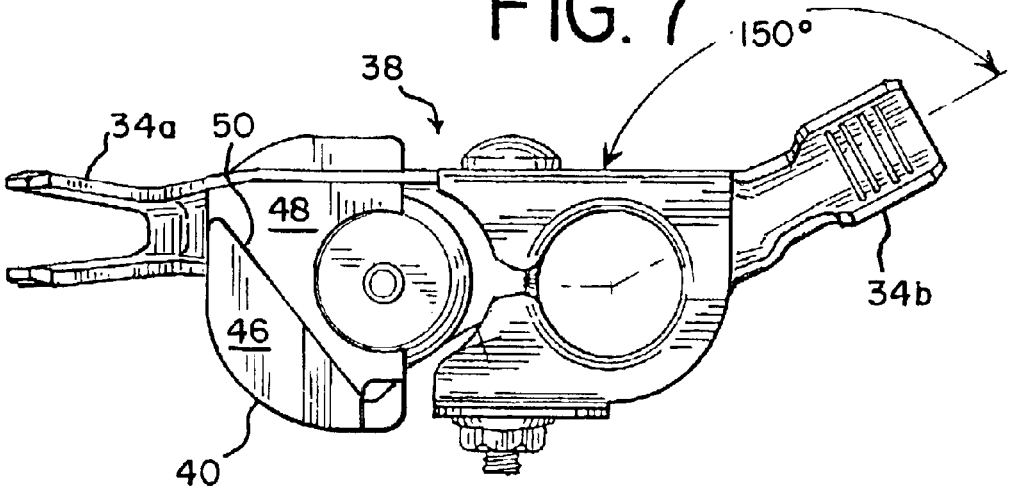
FIG. 7 is a top view of the connector of FIG. 6.

FIGS. 6–8 show the embodiment having an angle of approximately 150 degrees between the first ferrule 34*a* and the second ferrule 34*b*. This may best be seen in FIG. 7.

The battery terminal connector 10 of the invention also includes an auxiliary threaded rod-type terminal 36. This threaded rod-type terminal 36 is fixedly secured to the body portion 12 of the terminal connector 10. Electrical cables may be attached between power winch or other power consuming devices and this auxiliary, threaded rod-type terminal 36. In this way, these power consuming devices may be powered by the same battery to which the battery terminal connector 10 of the invention is secured.

Finally, the connector 10 includes a tightening nut 28*a* and bolt 28*b* assembly that may be accessed on either the right or left of that connector 10. The reason that this assembly can be accessed from either side is that the leading end of the bolt 28*b* can be inserted into either of the openings (not shown). Accordingly, the nut 28*a* can be either on the right or left of the connector 10, depending upon the direction that the bolt 28*b* was inserted.

As may be seen in FIGS. 6, 7, and 8, the connector 38 may include an anti-rotation element 40. This element 40 may be made of a single piece of molded polyethylene. The element 40 includes a lower, generally linear lower flange 42. This lower flange 42 is intended to abut tightly against a side wall (not shown) of the case of the automotive storage battery to which the connector 38 is secured. This tight abutment against the side wall of the storage battery prevents undesirable rotation of the connector 38 that could otherwise occur as a result of rotational forces that are occasionally imparted upon that connector 38. Such rotational forces can be imparted to the connector 38 when, for example, electrical cables for a power winch or other power consuming devices are attached to the auxiliary, threaded rod-type terminal 44. In particular, these rotational forces can be imparted upon the clockwise tightening of a nut which attaches these cables to the terminal 44.

The upper portion of the anti-rotation element 40 also includes a flange, here an upper flange 46. The upper flange 46 may include an essentially continuous linear, shaped ridge 50, as shown in FIGS. 6–8, or it may have a generally circular configuration (not shown). This essentially continuous ridge 50 that is positioned above the base portion 48 of the anti-rotation element 40. As with the linear lower flange 42, the ridge 50 of this upper flange 46 inhibits the excessive, undesired rotation of the electrical cables for auxiliary power consuming devices that may be attached to the terminal 44. This undesired, excessive rotation can occur, for example, when those electrical cables are torqued by the action of the nuts or other fasteners that secure the cables to the terminal 44.

A stamped, one-piece metal connector has been described which achieves good mechanical and electrical connection to the terminal post of a battery. The unique embodiments of the connector of the present invention offer enhanced adaptability to a variety of battery and vehicles, and affords easy and convenient connection and disconnection from the battery post through rotation of a standard fastener.

It is understood that, given the above description of the embodiments of the invention, various modifications may be made by one skilled in the art. Such modifications are intended to be encompassed by the claims below.

What is claimed is:

1. A battery terminal connector for securement to the battery post of an automotive storage battery, said connector having a body portion, the body portion having a front end and a back end, and a first and a second ferrule, the second ferrule being secured to the front end of the body portion, wherein said connector further includes an anti-rotation element including a generally linear lower flange that abuts against a side wall of the case of an automotive storage battery to which the connector is secured.

2. The battery terminal connector of claim 1, wherein the first ferrule is connected to the back end of the body portion.

3. The battery terminal connector of claim 2, wherein the first ferrule is separated from the second ferrule by an angle of approximately 180 degrees.

4. The battery terminal connector of claim 2, wherein the first ferrule is separated from the second ferrule by an angle of between approximately 150–180 degrees.

5. The battery terminal connector of claim 3, wherein a line passing through the first ferrule and the second ferrule define an axis, and wherein a line passing through the axis of the first ferrule and second ferrule passes through the battery terminal post to which the terminal connector is attached.

6. The battery terminal connector of claim 1, wherein the battery terminal connector is stamped of copper.

7. The battery terminal connector of claim 1, wherein the battery terminal connector is made of one piece.

8. The battery terminal connector of claim 6, wherein the battery terminal connector is made of one piece.

9. The battery terminal connector of claim 1, wherein the connector includes an auxiliary threaded rod-type terminal.

10. The battery terminal connector of claim 1, further including a tightening nut that may be accessed on either the right or left of the connector.

11. In a battery terminal connector having a front end and a back end, and further having a body portion folded from a single sheet of metal, the body portion including a contacting portion for engaging a battery terminal post and a first ferrule portion for attachment to a battery cable; the contacting portion including a first side and an opposed second side; a set of slotted openings formed within the first and second sides and asymmetrically aligned across from each other; and end tab portions extending from a distal edge of each of the first and second sides and adapted for overlapping and receiving a fastening means for clamping the contacting portion to the terminal post of a battery, a second ferrule portion extending from the front end of said connector, wherein said connector further includes an anti-rotation element including a generally linear lower flange that abuts against a side wall of the case of an automotive storage battery to which the connector is secured.

12. A battery terminal connector having a front and a back end, and further having:

a body portion formed from a single sheet of metal, comprising a contacting portion for attachment to a terminal post of a buttery and a first ferrule portion adapted for receiving a battery cable;

the contacting portion including a base and a first and a second side disposed to a connecting portion, the sides adapted to receive the terminal post of the battery; and the sides further including extending end tab portions the end tabs adapted for securing the sides into contact engagement with the terminal post of a battery;

a second ferrule portion extending from the front end of said connector;

and wherein said connector further includes an anti-rotation element including a generally linear lower flange that abuts against a side wall of the case of an automotive storage battery to which the connector is secured.

13. The battery terminal connector of claim 12 wherein each of the first and second aides include apertures for engagement with the terminal post of the battery.

14. The battery terminal connector of claim 12 wherein the end tabs are further adapted for overlapping relationship to one another and for receiving a fastener means for securing the sides into contact engagement with the terminal post of the battery.

15. The battery terminal connector of claim 14, wherein said battery terminal connector includes an upper flange.

16. The battery terminal connector of claim 15, wherein said upper flange includes an essentially continuous linear, shaped ridge.

17. The battery terminal connector of claim 15, wherein said upper flange has a generally circular configuration.

* * * * *

UNITED STATES PATENT AND TRADEMARK OFFICE

CERTIFICATE OF CORRECTION

PATENT NO. : 6,764,353 B2
DATED : July 20, 2004
INVENTOR(S) : Erik Freitag

It is certified that error appears in the above-identified patent and that said Letters Patent is hereby corrected as shown below:

Column 6,
Line 17, "buttery" should be -- battery --.
Line 33, "aides" should be -- sides --.

Signed and Sealed this

Sixth Day of September, 2005

JON W. DUDAS
*Director of the United States Patent and Trademark Office*